US007850104B2

(12) United States Patent
Havlena et al.

(10) Patent No.: US 7,850,104 B2
(45) Date of Patent: Dec. 14, 2010

(54) INFERENTIAL PULVERIZED FUEL FLOW SENSING AND MANIPULATION WITHIN A COAL MILL

(75) Inventors: Vladimir Havlena, Prague (CZ); Jaroslav Pekar, Pacov (CZ); Daniel Pachner, Prague (CZ)

(73) Assignee: Honeywell International Inc., Morristown, NJ (US)

( * ) Notice: Subject to any disclaimer, the term of this patent is extended or adjusted under 35 U.S.C. 154(b) by 878 days.

(21) Appl. No.: 11/726,149

(22) Filed: Mar. 21, 2007

(65) Prior Publication Data

US 2008/0230637 A1 Sep. 25, 2008

(51) Int. Cl.
*B02C 4/32* (2006.01)
*B02C 7/14* (2006.01)

(52) U.S. Cl. ..... 241/34; 241/119

(58) Field of Classification Search ..... 241/34, 241/119

See application file for complete search history.

(56) References Cited

U.S. PATENT DOCUMENTS 4,179,074 A * 12/1979 Flavel ..... 241/24.1
4,404,640 A * 9/1983 Dumbeck et al. ..... 702/182
4,611,763 A * 9/1986 Tomiyasu et al. ..... 241/30
5,386,945 A 2/1995 Nose et al.
5,611,494 A 3/1997 Williams
5,875,977 A 3/1999 Kozlak et al.
6,467,707 B1 10/2002 Williams, Jr. et al.

FOREIGN PATENT DOCUMENTS

GB 2281519 3/1995

OTHER PUBLICATIONS

"International Application Serial No. PCT/US2008/057329 Search Report and Written Opinion mailed Jul. 16, 2008", P220.

* cited by examiner

*Primary Examiner*—Bena Miller
(74) *Attorney, Agent, or Firm*—Schwegman, Lundberg, & Woessner, P.A.

(57) ABSTRACT

The subject matter herein relates to coal mills and, more particularly, inferential pulverized fuel flow sensing and manipulation within a coal mill. Various embodiments provide systems, methods, and software to manipulate a primary air flow rate and a coal feed rate into a coal mill to produce a target pulverized fuel flow. Some embodiments include sensing a differential pressure between two or more locations within a coal mill to estimate a recirculated load of coal at one or more stages within the coal mill.

15 Claims, 5 Drawing Sheets

INFERENTIAL PULVERIZED FUEL FLOW SENSING AND MANIPULATION WITHIN A COAL MILL

TECHNICAL FIELD

The subject mater herein relates to coal mills and, more particularly, inferential pulverized fuel flow sensing and manipulation within a coal mill.

BACKGROUND INFORMATION

Traditionally, coal pulverizers have been controlled using the concept of load line defining the relation between the coal feed "CF" (kg/second) and primary air "PA" ($m^3$/second) flow. The load line is selected to guarantee reliable and acceptable operations of the mill, based on conservative, worst case scenario both in terms of mill grinding element wear during a maintenance cycle as well as in terms of varying coal properties. However, this load line control strategy fails to take into account the dynamics of the coal pulverizing and transport process. The load line concept relies on a one-to-one mapping between the combination of CF and PA flows to a pulverized fuel "PF" flow. The relationship of the combination of CF and PA to PF is well defined only in a coal mill steady-state condition. Otherwise, the PF flow may differ from the CF flow considerably. Moreover, the conservative approach is not optimal from the point of view of mill economy—minimization of overall energy consumption of coal pulverizing and transport.

DETAILED DESCRIPTION

In the following detailed description, reference is made to the accompanying drawings that form a part hereof, and in which is shown by way of illustration specific embodiments in which the inventive subject matter may be practiced. These embodiments are described in sufficient detail to enable those skilled in the art to practice them, and it is to be understood that other embodiments may be utilized and that structural, logical, and electrical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed.

The following description is, therefore, not to be taken in a limited sense, and the scope of the subject matter herein is defined by the appended claims.

The functions and algorithms described herein are implemented in hardware, software, or a combination of software and hardware in one embodiment. The software comprises computer executable instructions stored on computer readable media such as memory or other type of storage devices. The term "computer readable media" is also used to represent carrier waves on which the software is transmitted. Further, such functions correspond to modules, which are software, hardware, firmware, or any combination thereof. Multiple functions are performed in one or more modules as desired, and the embodiments described are merely examples. The software is executed on a digital signal processor, ASIC, microprocessor, or other type of processor operating on a system, such as a personal computer, server, a router, or other device capable of processing data including network interconnection devices.

Some embodiments implement the functions in two or more specific interconnected hardware modules or devices with related control and data signals communicated between and through the modules, or as portions of an application-specific integrated circuit. Thus, the exemplary process flow is applicable to software, firmware, and hardware implementations.

Figure 1:
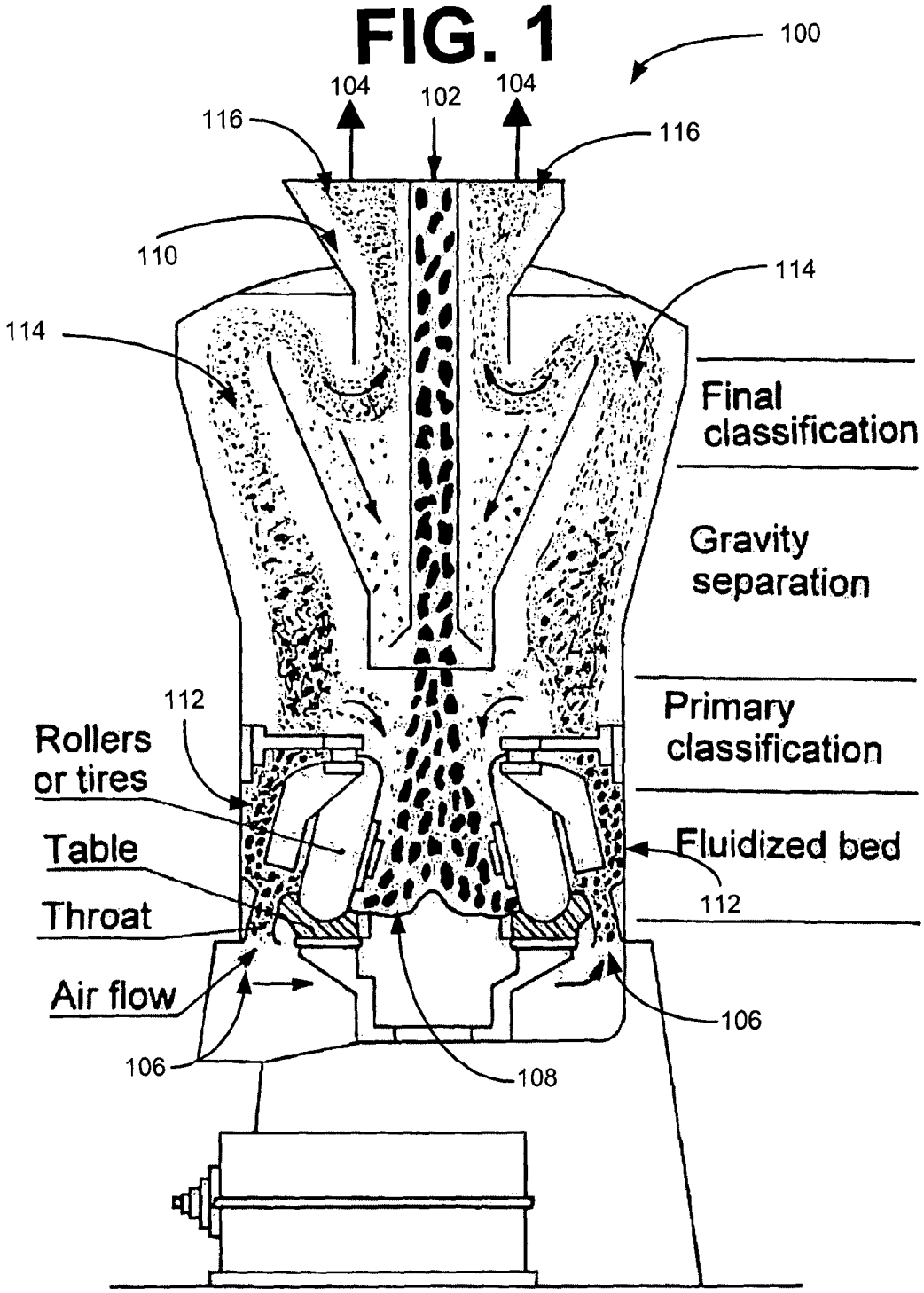
FIG. 1 is a cross-section of a vertical coal mill according to an example embodiment.

FIG. 1 is a cross-section of a vertical coal mill 100 according to an example embodiment. Coal is fed into the mill 100 at intake 102. The coal input 102 flow is referred to as coal feeder flow "CF" and is measured in kg/second. The coal flows down to pulverizing area 108 where rollers or tires pulverize the coal, depending on the particular mill of a particular embodiment.

Primary air is forced into the mill at air intakes 106. The air input into the mill at air intakes 106 is referred to as primary air "PA" flow and is measured in $m^3$/second. The air flows through the outside of the coal pulverizing area 108 and suspends the pulverized coal in the air flow. The suspended pulverized coal flows with the air stream up through the mill 100. A primary classification occurs via gravity which pulls larger pieces of pulverized coal from the air stream back into the coal intake stream. The smaller pieces of pulverized coal continue to be suspended in the air stream and flow to another pulverized coal classification area where, again, the larger coal pieces fall out of the air stream via gravity and the smaller pieces of pulverized coal continue to be suspended in the air stream and are output from the coal mill at outputs 104. The coal output is referred to as pulverized fuel "PF" flow and is measured in kg/second.

A recirculated coal load "RL" is the total amount of coal that is recirculated in the mill and partly (fine particles) is carried away the mill as PF flow, partly (coarse particles) falls out of the air stream and back into the coal intake stream as the pulverized coal flows through the mill 100 after pulverization. Direct measurement of the RL in kg is difficult. Further, PF measurement is also difficult and expensive due to the nature of equipment needed to make such measurements. However, even if measured, accuracy of the direct measurement of PF and RL would at times be suspect.

The present subject matter provides systems, methods, and software for inferential sensing of RL and PF as a function of differential pressure sensing between at least two locations within a coal mill. This allow for manipulation, and even optimization of PF to a combustion process. Modification of various variables allows for fine-tuning of mill operation and the PF and thus, great optimization capabilities in the coal milling and combustion processes.

In some embodiments, to provide efficient and responsive mill 100 operation, RL may be stabilized by coordinated control of the PA and CF resulting in optimized coal pulverizing process and transport of PF from the mill. As the RL is generally not a directly measurable variable, some embodiments provide a model based approach to estimate the internal state of the pulverizing process in the mill 100 from the measurable input-output variables. The model is based on mill mass and energy balances and is developed with constraint that all the internal states are observable. For example, a Kalman filter, or other stochastic state observer, may be used to estimate the internal mill 100 state during operation.

Air pressure between two or more locations within a fuel path of the coal mill 100 may be sensed and a differential pressure dP determined. The dP may be used to provide information to a determine from the model, how much of the CF flow and PA air flow is being discharged from the mill 100 as PF. In some such embodiments, the two or more locations within a fuel path of the coal mill 100 where the dP is sensed include a location prior to a pulverized coal recirculation, or classification, point and a location after the pulverized coal recirculation, or classification, point.

Some embodiments employ a shift register structure along with a Kalman filter to help increase dynamic responsiveness of the coal mill 100. Rock coal is pulverized at the bottom of the mill through various mean diameter states to the final fine powder state. As illustrated in FIG. 1, the coal passes three powder states 112, 114, 116. Each powder state can be represented in a shift register stage. The actual number of shift register stages is a compromise between model complexity and accuracy as described in the following. The mean diameter of a rock coal particle decreases continuously with time due to abrasion taking place among the moving coal particles. To simplify the model of the mill and its control algorithm this continuous diameter change is represented by a number of discontinues parameter changes in the embodiment. The rock coal particles in the mill are approximately represented by a mixture of a small number of diameters (three, for example). Every second, a certain fraction of particles with a diameter change pass to the smaller diameter stages. This fraction can be related to the mean time the particle stays on that diameter stage. The proportion of the diameters in the mixture changes steadily in time in the way the number of smaller diameter particles increase extracting their mass from the greater diameter particles material. This process is referred to as the shift register mill structure.

A series of experiments can be carried through to determine the particle mean stay times. The masses of rock coal particles existing at a time on the diameter stages represent the mill internal state. The number of state variables is the same as the number of stages. Then the Kalman filter algorithm is deployed to estimate the mill state (i.e. the masses) using one or more of the following items of information. (1) The mean stay times information ascertained via experiments with the mill. (2) The mass preservation law stating the difference of masses supplied to and extracted from the mill must exist in the mill. (3) The CF and PA measurements. (4) The boiler thermal output and the oxygen concentration in the flue gases leaving the combustion process (which is related to the coal mass burnt via the stoichiometric equations). (5) The air pressure measured on several (at least two) places at various heights over the mill bottom. These five items of information will help to infer the rock coal mass on the defined diameter stages. Knowing the mill state estimate and its uncertainty it is then easier to calculate the correct PA control action to achieve a desired PF. For example suppose a PF increase is necessary: Knowing there is almost no mass on the finest diameter stage the control algorithm can deduct it will be necessary to use a higher PA values to carry away a fraction of greater diameter heavier particles from the mill. On the contrary, knowing the PA values were low for a number of seconds, the control algorithm can deduce the mass of the finest particles had been accumulated during that period of time and only a moderate PA increase will be sufficient to achieve a desired PF increase. The prior information embedded in the shift register structure is a mathematical model of accumulation of mass in individual diameter stages, the mean particle stay time on each individual stage and the mass conservation law.

The Kalman filter is used to estimate the actual instantaneous coal mass content at the individual register stages that correspond to power states 112, 114, 116. The last stage 116 content provides the control system with the information of how much PF can be gained by instantaneously increasing PA. The previous stage contents 112, 114 provide the control system with the information of how much coal powder will be available after a number of seconds. Sensing dP on a refined grid, an estimation algorithm can estimate the coal content at the individual stages 112, 114, 116 through the stages of the shift register. By sensing dP at each of the stages 112, 114, 116, an estimate can be made of the mass of coal powder in each stage. This allows more accurate observation of internal mill operation and provides an increased accuracy to PF prediction. Thus, dynamic responsiveness of the coal mill 100 is increased because the amount of coal powder available at each stage 112, 114, 116 can be more accurately estimated and controlled.

Figure 2:
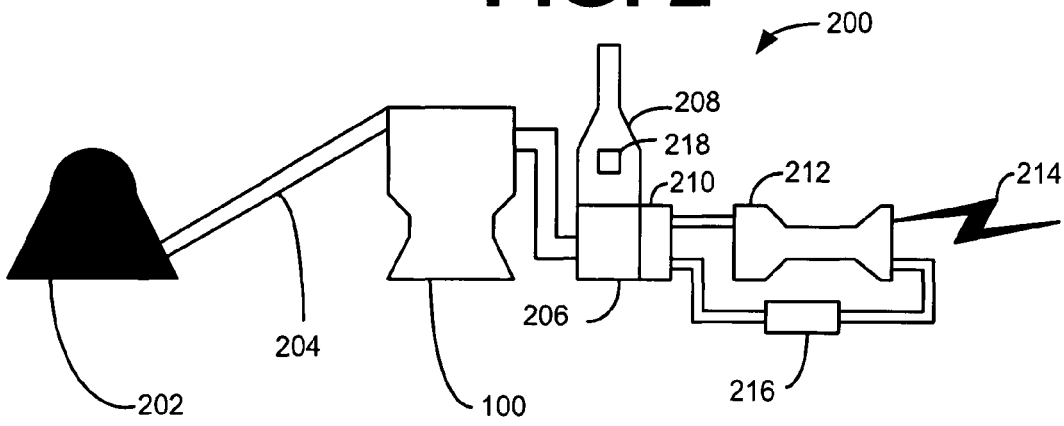
FIG. 2 is an illustration of a power generation plant according to an example embodiment.

FIG. 2 is an illustration of a power generation plant 200 according to an example embodiment. The power generation plant 200 includes a coal pile 202 which is drawn from by an elevator 204. The elevator 204 delivers coal to the mill 100 which pulverizes the coal and feeds the pulverized coal suspended in an air stream, as described above, to a combustion chamber 206. The combustion chamber 206 also may be fed with a secondary air stream to provide additional oxygen to ensure complete combustion of the coal. The coal is burned within the combustion chamber 206 to heat water to create and superheat steam in a boiler 210. Steam flows from the boiler 210 through a turbine 212 which causes the turbine to spin under the pressure of the steam. The spinning turbine 212 generates a flow of electricity 214 which is fed to a power grid. The steam flows from the turbine 212 to a condenser 216 which causes the water of the steam to be converted from a gas form back to a liquid form. The water then flows back to the boiler 210. The condenser may be cooled in any number of ways, including by water pulled into the condenser from a body of water such as a pond, lake, river, or other body of water.

Exhaust gases from the burning of the coal in the combustion changer 206 are discharged through a stack, such as flue 208. In some embodiments, an oxygen concentration is sensed by an oxygen sensor 218. Although oxygen measurement within the flue 208 is not directly linked to mill 100 control, it provides information about the total air/fuel ratio being fed to and burned within the combustion chamber 206. Total air includes PA used to transport the PF and one or more secondary air flows fed to the combustion chamber 206 to ensure complete combustion of the coal. However, generally speaking, the total air flow should be optimized to minimize the losses in sensible heat of flue 208 gases under the constraint on CO, opacity and unburnt fuel (loss of ignition LOI).

If the total air/fuel ratio is stoichiometric, there should be no oxygen in the flue gas. However, in practice, an increased amount of air should be used due to imperfect mixing of air and fuel and other uncontrollable confounds to the combustion process, resulting in non-zero oxygen in the flue gases. This commonly results in an oxygen concentration in the flue 206 gases of 2-3%.

Thus, the link between oxygen and mill 100 control is to optimize combustion efficiency by reducing the mean air/fuel ratio. To be able to reduce the air/fuel ratio, the variability of the air/fuel ratio needs to be reduced. The be able to reduce air/fuel ratio variability, tight control of PF is needed. PF flow is controlled by PA flow, but the relation between PA and PF depend on the RL in the mill. Thus, to more accurately optimize combustion within the combustion chamber 206, the RL and PF need to be known. The more certainty to which the RL and PF are known, the greater the optimization capabilities for mill 100 and combustion chamber 206 operation.

Figure 3:
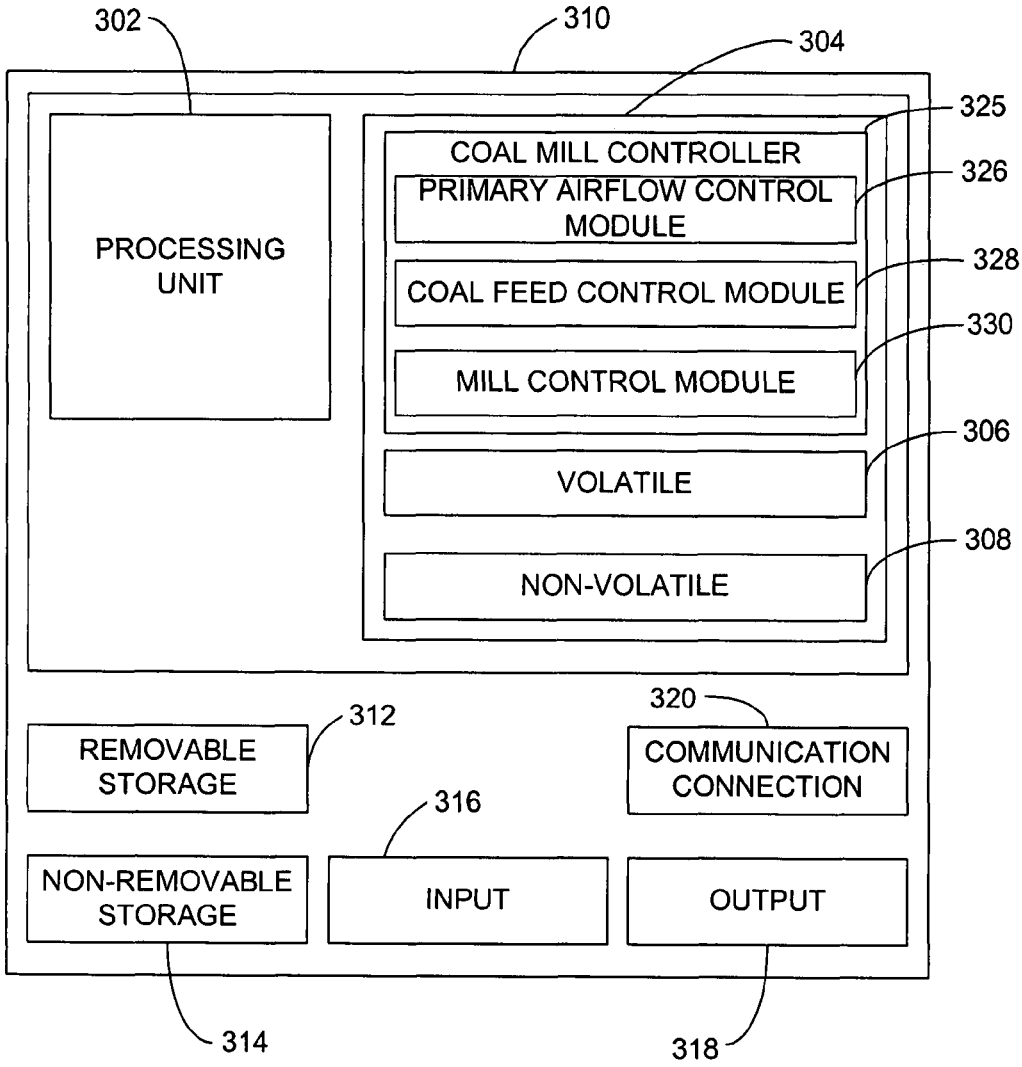
FIG. 3 is a block diagram of a computing device according to an example embodiment.

FIG. 3 is a block diagram of a computing device according to an example embodiment. In one embodiment, multiple such computer systems are utilized in a distributed network to implement multiple components in a transaction based environment. An object oriented architecture may be used to implement such functions and communicate between the multiple systems and components. One example computing device in the form of a computer 310, may include a processing unit 302, memory 304, removable storage 312, and non-removable storage 314. Memory 304 may include volatile memory 306 and non-volatile memory 308. Computer 310 may include—or have access to a computing environment that includes—a variety of computer-readable media, such as volatile memory 306 and non-volatile memory 308, removable storage 312 and non-removable storage 314. Computer storage includes random access memory (RAM), read only memory (ROM), erasable programmable read-only memory (EPROM) & electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage or other magnetic storage devices, or any other medium capable of storing computer-readable instructions. Computer 310 may include or have access to a computing environment that includes input 316, output 318, and a communication connection 320. The computer may operate in a networked environment using a communication connection to connect to one or more remote computers, such as database servers. The remote computer may include a personal computer (PC), server, router, network PC, a peer device or other common network node, or the like. The communication connection may include a Local Area Network (LAN), a Wide Area Network (WAN) or other networks.

Computer-readable instructions stored on a computer-readable medium are executable by the processing unit 302 of the computer 310. A hard drive, CD-ROM, and RAM are some examples of articles including a computer-readable medium. The term "computer readable medium" is also used to represent carrier waves on which the software is transmitted. For example, a computer program capable of providing a generic technique to perform an access control check for data access and/or for doing an operation on one of the servers in a component object model (COM) based system according to the teachings of the present invention may be included on a CD-ROM and loaded from the CD-ROM to a hard drive. The computer-readable instructions allow computer 310 to provide generic access controls in a COM based computer network system having multiple users and servers.

In some embodiments, the computer-readable instructions stored in the memory 304 include a coal mill controller 325. The coal mill controller 325 is a program to control operation of a coal mill, such as coal mill 100 of FIG. 1 and FIG. 2. In some embodiments, the coal mill controller 304 includes a primary airflow control module 326, a coal feed control module 328, and a mill control module 330.

The mill control module 330, in some embodiments, receives pressure signals from one or more differential pressure sensors within a coal mill that sense pressure differences "dP" between at least two locations within a fuel path of a coal mill. The mill control module 330 may further include an instruction set, operable on the processing unit to cause the coal mill controller 304 to receive a PA rate from the primary airflow control module 326 and receive a CF rate from the coal feed control module 328. The mill control module may further determine a RL of coal within the coal mill and a PF flow of coal from the coal mill. The RL and PF are determined as a function of the dP measurement, the PA rate, and the CF rate. The determined recirculated load RL of coal and the PF flow of coal with the received PA rate and CF rate are then stored in the memory 304.

The primary airflow control module 326 controls the amount of air fed to the mill 100. The primary air flow control module 326 may issue control signals to a blower forcing air into the mill. The coal feed control module 328 controls the amount of coal fed into the mill 100 by issuing control signals to one or more of the elevator 204 and a device that allows coal into the mill 100 at coal intake 102.

In some embodiments, the mill control module 330 is further operable to receive a target PF flow from another module of the coal mill controller 325 or other module or system that operates to control operation of a power generation plant 200. The mill control module 330 then determines a PA rate and target CF rate to achieve the target PF flow from the coal mill. The mill control module 330 then sends a PA rate command to the primary airflow control module 326 to cause the target PA rate to be achieved within the coal mill 100. The mill control module 330 may further send a coal feed rate command to the coal feed control module 328 to cause the target coal feed rate to be achieved within the coal mill 100.

In some embodiments, the mill control module 330 determines the coal feed rate and the PA rate as a function of a model. In some embodiments, the model is a Kalman filter which provides continuously updated information about coal mill operation given only a sequence of PA rate, CF rate, and dP measurements and estimations of PF flow. The Kalman filter may then be used to adjust the coal feed rate and the PA rate to achieve a given target PF rate.

As one of skill in the art would recognize, there are variations in the inputs to a coal fired process that can affect the combustion process. Some such variations include coal moisture content and the calorific of the coal. However, by accounting for these variables in the Kalman filter as noise, accurate determinations of PA and CF rates may still be made.

In some embodiments, the model used by the mill control module 330 to determine coal feed and PA rates is refined as a function of one or more of the stored RL, PF, PA, CF, and dP. In some such embodiments, the refined model is an adaptive model.

The mill control module 330 may be further operable to receive and store a target flue gas oxygen level for flue gases flowing from a combustion process fed by operation of the coal mill. The mill control module 330, in such embodiments, further receives a sensed flue gas oxygen level sensed from the combustion process fed by operation of the coal mill. The mill control module then determines the PA rate and target CF rate as a function of the stored target flue gas oxygen level to cause the flue gas oxygen level to approach and achieve the flue gas oxygen level target. In some such embodiments, the determination of the PA rate and target CF rate causes the PF flow to meet a target PF flow while also achieving the target flue gas oxygen level.

Figure 4:
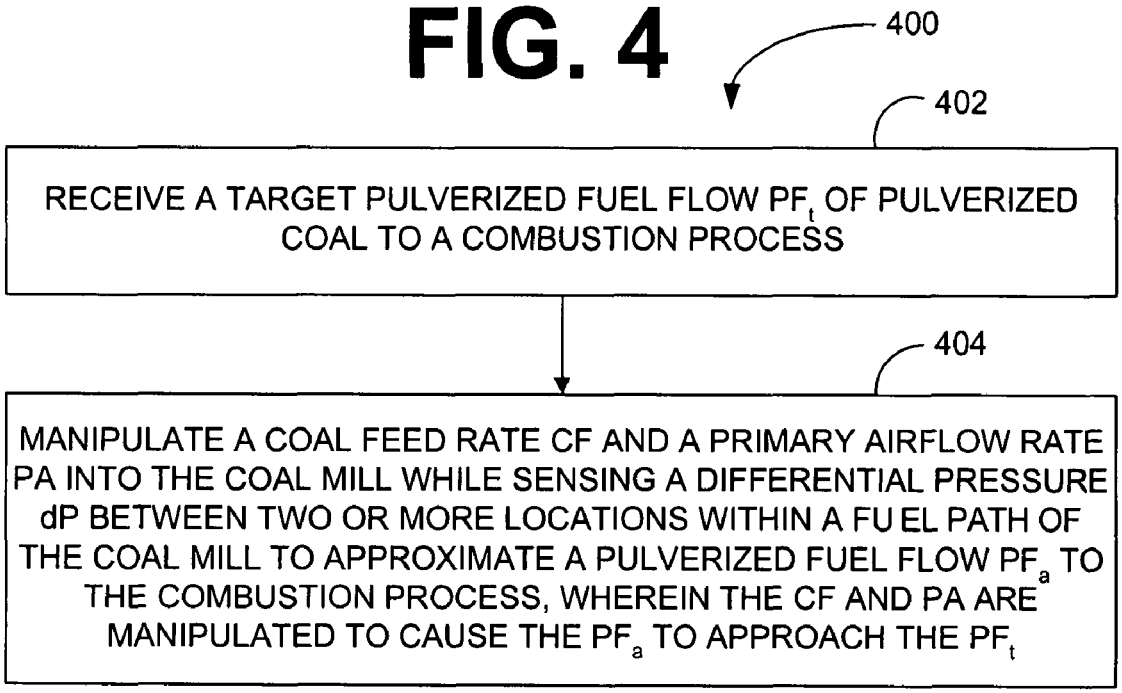
FIG. 4 is a block diagram of a method according to an example embodiment.

FIG. 4 is a block diagram of a method 400 according to an example embodiment. The example method 400 is performed to control a coal mill, such as coal mill 100. In some embodiments, the method 400 includes receiving a target pulverized fuel flow $PF_t$ of pulverized coal to a combustion process 402. The method 400 further includes manipulating a coal feed rate CF and a primary airflow rate PA into the coal mill while sensing a differential pressure dP between two or more locations within a fuel path of the coal mill to approximate a pulverized fuel flow $PF_a$ to the combustion process 404. In such embodiments, the CF and PA are manipulated to cause the $PF_a$ to approach the $PF_t$. CF and PA typically are manipulated as a function of a model, such as a Kalman filter based model.

Figure 5:
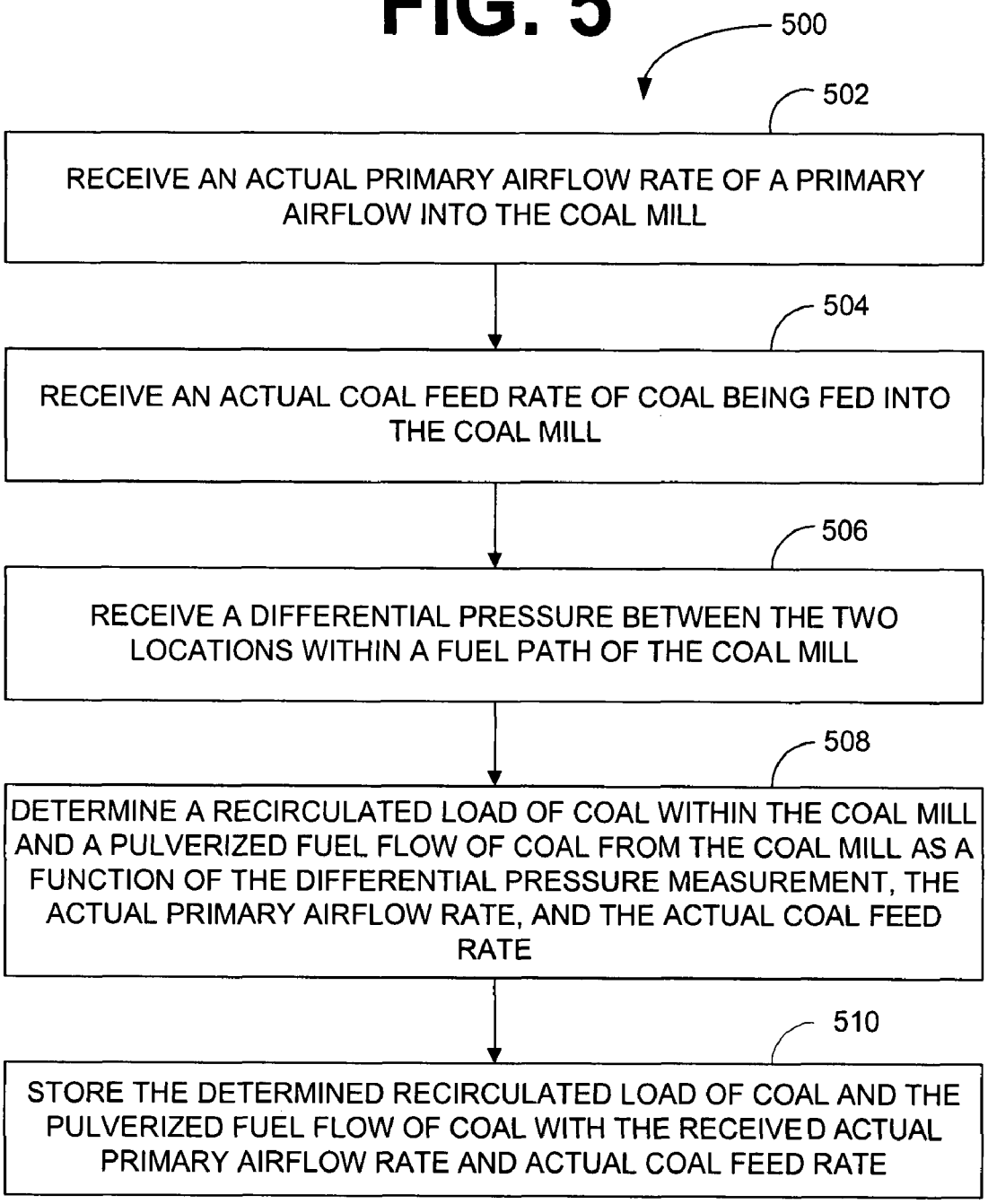
FIG. 5 is a block diagram of a method according to an example embodiment.

FIG. 5 is a block diagram of a method 500 according to an example embodiment. The method 500 may be performed to control coal mill. The method 500 includes receiving a primary airflow rate of a primary airflow into the coal mill 502, a coal feed rate of coal being fed into the coal mill 504, and a differential pressure between the two locations within a fuel path of the coal mill 506. The method 500 further includes determining a recirculated load of coal within the coal mill and a pulverized fuel flow of coal from the coal mill as a function of the differential pressure measurement, the primary airflow rate, and the coal feed rate 508. Some such embodiments also include storing the determined recirculated load of coal and the pulverized fuel flow of coal with the received primary airflow rate and coal feed rate 510. The storing of this data may be used to refine a model used to determine coal feed rates and primary air flow rates in view of differential pressures. Refining the model also allows for a model to be calibrated to a specific mill. Thus, after a short period of time, or after performance of calibration testing, a model may be calibrated to help optimize and increase the dynamic responsiveness of a particular mill.

It is emphasized that the Abstract is provided to comply with 37 C.F.R. §1.72(b) requiring an Abstract that will allow the reader to quickly ascertain the nature and gist of the technical disclosure. It is submitted with the understanding that it will not be used to interpret or limit the scope or meaning of the claims.

In the foregoing Detailed Description, various features are grouped together in a single embodiment to streamline the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

It will be readily understood to those skilled in the art that various other changes in the details, material, and arrangements of the parts and method stages which have been described and illustrated in order to explain the nature of this invention may be made without departing from the principles and scope of the invention as expressed in the subjoined claims.

What is claimed is:

1. A coal mill controller comprising:

a primary airflow control module;

a coal feed control module;

differential pressure sensors to sense pressure differences between each of a plurality of sets of two locations within a fuel path of a coal mill, each differential pressure sensed with respect to a powder stage of coal within the fuel path of the coal mill;

a mill control module including an instruction set, operable on a processing device interconnected with the primary airflow and coal feed control modules and the differential pressure sensors, to cause the coal mill controller to:

receive, from the primary airflow rate control module, a primary airflow rate of a primary airflow into the coal mill;

receive, from a coal feed control module, a coal feed rate of coal being fed into the coal mill;

receive, from the differential pressure sensors, differential pressures each sensed with respect to a powder stage within the fuel path of the coal mill;

determine a recirculated load of coal within the coal mill and a pulverized fuel flow of coal from the coal mill as a function of the differential pressure measurements, the primary airflow rate, and the coal feed rate;

estimate a mass of coal powder in each powder stage within the fuel path of the coal mill; and store the determined recirculated load of coal, the estimated masses of coal powder in each powder stage, and the pulverized fuel flow of coal with the received primary airflow rate and coal feed rate.

2. The coal mill controller of claim 1, wherein the instruction set of the mill control module is further operable on the processing device to cause the mill controller to:

receive a target pulverized fuel flow;

determine a primary airflow rate and target coal feed rate to achieve the target pulverized fuel flow from the coal mill;

send a primary air flow rate command to the primary airflow control module to cause the target primary airflow rate to be achieved within the coal mill; and send a coal feed rate command to the coal feed control module to cause the target coal feed rate to be achieved within the coal mill.

3. The coal mill controller of claim 2, wherein the coal feed rate and primary air flow rate are determined as a function of a model.

4. The coal mill controller of claim 3, wherein the model is a Kalman filter.

5. The coal mill controller of claim 4, wherein disturbance variables of the Kalman filter include a coal moisture content value and a coal calorific value.

6. The coal mill controller of claim 2, wherein the model is refined as a function of the stored determined recirculated load of coal, pulverized fuel flow of coal, and the primary airflow rate and coal feed rate.

7. The coal mill controller of claim 1, wherein the two or more locations within a fuel path of the coal mill where the differential pressure is sensed include a location prior to a pulverized coal recirculation point and a location after the pulverized coal recirculation point.

8. The coal mill controller of claim 1, wherein the instruction set of the mill control module is further operable on the processing device to cause the coal mill controller to:

receive and store a target flue gas oxygen level for flue gases flowing from a combustion process fed by operation of the coal mill;

receive a sensed flue gas oxygen level sensed from the combustion process fed by operation of the coal mill; and determine the primary airflow rate and target coal feed rate as a function of the stored target flue gas oxygen level to cause the flue gas oxygen level to approach and achieve the flue gas oxygen level target.

9. A method of coal mill control comprising:

receiving a primary airflow rate of a primary airflow into the coal mill;

receiving a coal feed rate of coal being fed into the coal mill;

receiving differential pressures sensed between each of a plurality of sets of two locations within a fuel path of the coal mill, each differential pressure sensed with respect to a powder stage of coal within the fuel path of the coal mill;

determining a recirculated load of coal within the coal mill and a pulverized fuel flow of coal from the coal mill as a function of the differential pressure measurements, the primary airflow rate, and the coal feed rate; and storing the determined recirculated load of coal and the pulverized fuel flow of coal with the received primary airflow rate and coal feed rate.

10. The method of coal mill control of claim 9, further comprising:

receiving a target pulverized fuel flow;

determining a primary airflow rate and target coal feed rate to achieve the target pulverized fuel flow from the coal mill;

sending a primary air flow rate command to the primary airflow control module to cause the target primary airflow rate to be achieved within the coal mill; and sending a coal feed rate command to the coal feed control module to cause the target coal feed rate to be achieved within the coal mill.

11. The method of coal mill control of claim 10, wherein the coal feed rate and primary air flow rate are determined as a function of a model.

12. The method of coal mill control of claim 11, wherein the model is a Kalman filter.

13. The method of coal mill control of claim 12, wherein disturbance variables of the Kalman filter include a coal moisture content value and a coal calorific value.

14. The method of coal mill control of claim 9, wherein the two or more locations within a fuel path of the coal mill where the differential pressure is sensed include a location prior to a pulverized coal recirculation point and a location after the pulverized coal recirculation point.

15. The method of coal mill control of claim 9, further comprising:

receiving and storing a target flue gas oxygen level for flue gases flowing from a combustion process fed by operation of the coal mill;

receiving a sensed flue gas oxygen level sensed from the combustion process fed by operation of the coal mill; and determining the primary airflow rate and target coal feed rate as a function of the stored target flue gas oxygen level to cause the flue gas oxygen level to approach and achieve the flue gas oxygen level target.

* * * * *